US005097850A

United States Patent [19]

Braunshteyn et al.

[11] Patent Number: 5,097,850

[45] Date of Patent: Mar. 24, 1992

[54] REFLECTOR SLEEVE FOR FLAVOR GENERATING ARTICLE

[75] Inventors: Mikhail Braunshteyn; Andrew J. Gillespie, both of Richmond; John C. Hamersley, Midlothian, all of Va.

[73] Assignee: Philip Morris Incorporated, New York, N.Y.

[21] Appl. No.: 605,860

[22] Filed: Oct. 17, 1990

[51] Int. Cl.[5] ..... A24D 1/00

[52] U.S. Cl. ..... 131/194; 131/192; 131/361

[58] Field of Search ..... 131/194, 335, 228, 361, 131/362, 192; 229/3.5 MF, 4.5, 93; 29/469.5; 15/427–433; 72/368, 369; 401/52, 88

[56] References Cited

U.S. PATENT DOCUMENTS 534,505 2/1895 Hartsock ..... 131/228

*Primary Examiner*—V. Million
*Assistant Examiner*—J. Doyle
*Attorney, Agent, or Firm*—Jeffrey H. Ingerman

[57] ABSTRACT

A radiant energy reflector sleeve is provided for a smoking or flavor generating article of the type having a heat source and a flavor bed which generates a flavored aerosol or other flavors when heated. The sleeve can be erected from a one-piece foil blank in a continuous or semi-continuous process as part of the assembly of the article.

25 Claims, 4 Drawing Sheets

FIG.4
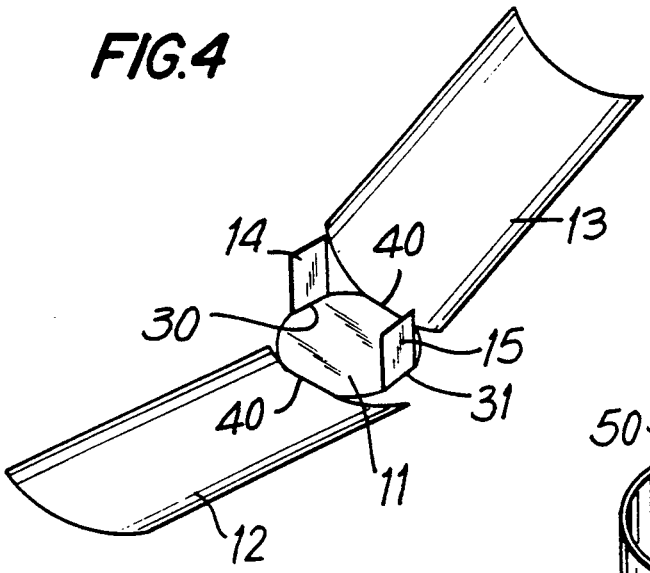
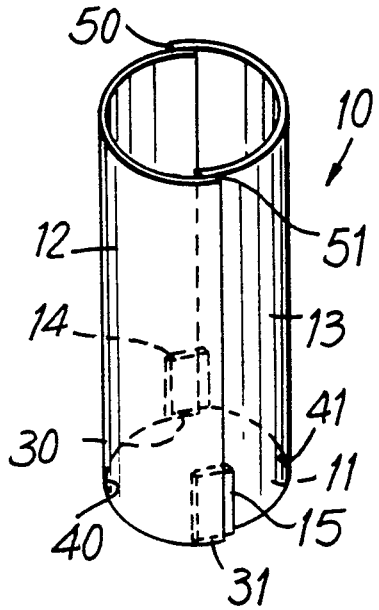
FIG.5
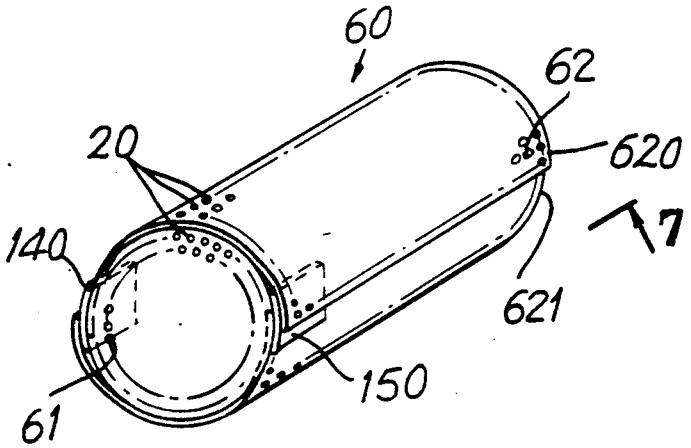
FIG.6

FIG.10
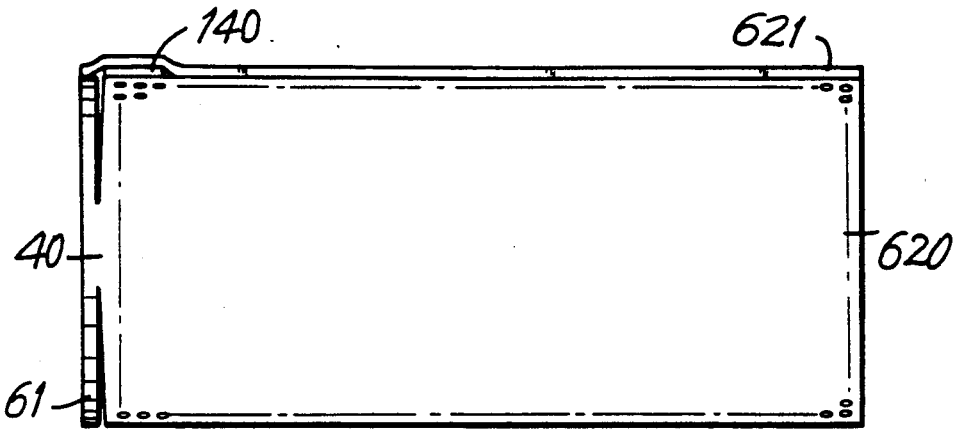
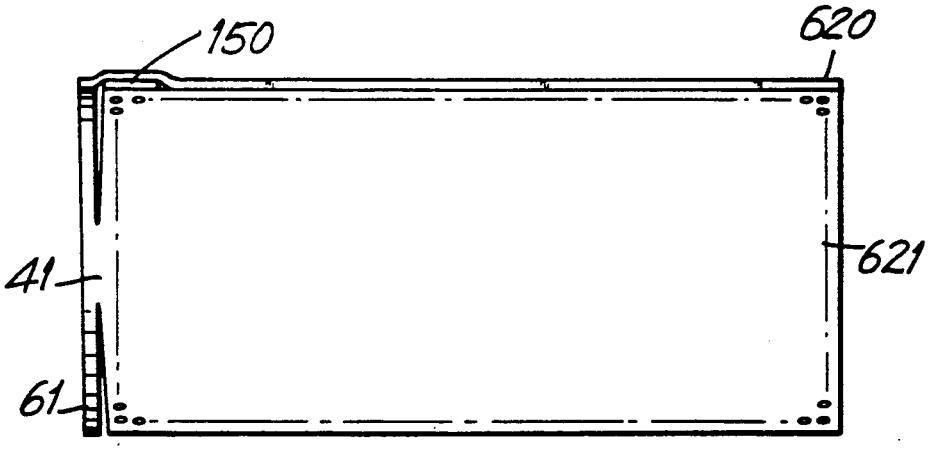
FIG.11

REFLECTOR SLEEVE FOR FLAVOR GENERATING ARTICLE

BACKGROUND OF THE INVENTION

This invention relates to smoking or flavor generating articles of the type in which a heat source provides hot air for drawing through a flavor bed to release tobacco or other flavors, and more particularly to a reflector sleeve for use with the heat source in such an article.

Copending, commonly-assigned U.S. patent application Ser. No. 07/222,961, filed July 22, 1988, still pending, copending, commonly-assigned U.S. patent application Ser. No. 07/223,153, filed July 22, 1988, now U.S. Pat. No. 4,991,606, copending, commonly-assigned U.S. patent application Ser. No. 07/315,822, filed Jan. 27, 1989, now U.S. Pat. No. 4,966,171, and copending, commonly-assigned U.S. patent application Ser. No. 07/571,730 filed Aug. 24, 1990, each of which is hereby incorporated by reference in its entirety, all describe smoking or flavor generating articles that can mimic conventional cigarettes. In each of said applications, the article described has an active element that includes a sleeve in which is suspended a heat source containing carbon, a metal nitride, or some combination thereof, which burns to produce substantially only carbon dioxide. Such a heat source is described in copending, commonly assigned U.S. patent applications Ser. No. 07/223,232, filed July 22, 1988 and Ser. No. 07/443,636, filed Nov. 29, 1989, each of which is hereby incorporated by reference in its entirety. The active element also includes a material, such as tobacco-containing pellets of the type described in copending U.S. patent application Ser. No. 07/222,831, filed July 22, 1988, now U.S. Pat. No. 4,981,522, which is hereby incorporated by reference in its entirety, that releases tobacco or other flavors when heated by the drawing of air through the heat source and then through it.

In the articles described in said above-incorporated copending applications, the heat source is suspended in a sleeve at the distal end of the article. In each case the sleeve is preferably reflectorized in order to radiate heat back to the heat source to keep it hot enough to maintain combustion, and the sleeve is preferably air permeable in order to admit air to support combustion. The sleeve can be inherently air permeable, or it can be rendered air permeable by perforation.

Several different sleeve constructions are described in the above-incorporated applications. In one application, a ceramic sleeve of controlled porosity is lined with a perforated metal foil layer. In another, a layer of perforated metal foil is overwrapped by a layer of porous or perforated paper. In both of these constructions, a stainless steel or other reflective metallic end cap is added after the sleeve is assembled. The end cap prevents dropout of a hot heat source if it becomes loose, cracked or broken. In still another construction, a drawn aluminum cup is used, eliminating the need for a separate end cap. The aluminum cup in that construction is fluted to provide air ducts, as well as to match the inside and outside thicknesses of other components of the article.

The first two of the above described constructions requires several assembly steps because of the different layers involved and the use of a separate end cap, and all three constructions must be assembled at a separate location from the article, and then brought to the location where the article is assembled. The various assembly steps may require a number of different machines as well.

It would be desirable to be able to provide a reflector sleeve for a smoking or flavor generating article that has an integral end cap. It would also be desirable to be able to provide such a sleeve that could be formed as part of the assembly of the article.

SUMMARY OF THE INVENTION

It is an object of this invention to provide a reflector sleeve for a smoking or flavor generating article that has an integral end cap. It is also an object of this invention to provide such a sleeve that could be formed as part of the assembly of the article.

In accordance with this invention, there is provided a radiant energy reflector sleeve for use in an active element of a smoking article having a heat source and a flavor bed in radiative and convective heat transfer relationship with the heat source, the heat source being suspended within the radiant energy reflector sleeve. The radiant energy reflector sleeve comprises a substantially cylindrical metallic wall, a substantially circular metallic end face having a perimeter, and stiffening elements. The wall, the end face and the stiffening elements are all erected from a single blank. The wall comprises two substantially semicylindrical wall segments foldedly connected to the end face at respective substantially diametrically opposed first and second portions of the perimeter. The stiffening elements comprise two tabs foldedly connected to the end face at respective third and fourth portions of the perimeter.

A blank for forming the sleeve, as well as a method of forming the sleeve, are also provided.

BRIEF DESCRIPTION OF THE DRAWINGS

The above and other objects and advantages of the invention will be apparent upon consideration of the following detailed description, taken in conjunction with the accompanying drawings, in which like reference characters refer to like parts throughout, and in which:

FIG. 4 is a perspective view of the blank of FIG. 3 after it has been further, but still partially, erected;

FIG. 5 is a perspective view of the blank of FIG. 1 after it has been completely erected;

FIG. 6 is a front perspective view of a completed reflector sleeve according to the present invention;

FIG. 10 is a top plan view of the reflector sleeve of FIGS. 6–9, taken from line 10—10 of FIG. 7; and FIG. 11 is a bottom plan view of the reflector sleeve of FIGS. 6–9, taken from line 11—11 of FIG. 7.

DETAILED DESCRIPTION OF THE INVENTION

Figure 1:
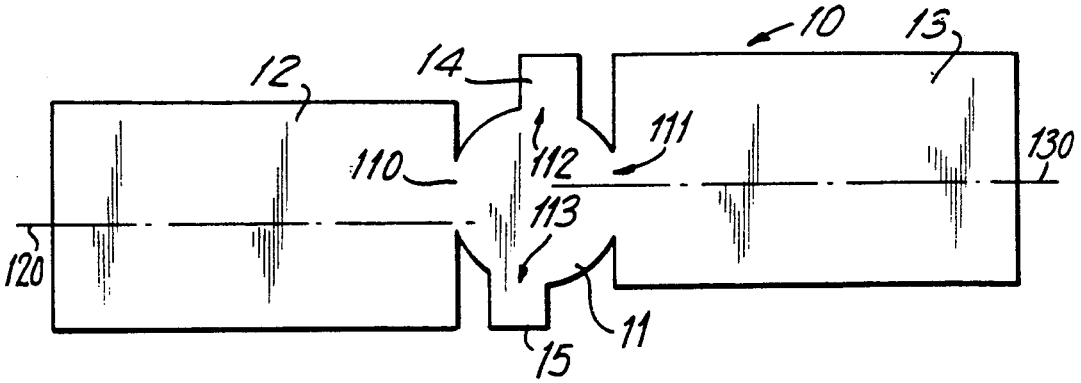
FIG. 1 is a plan view of blank for a reflector sleeve according to the present invention.

The radiant energy reflector sleeve of this invention is formed from a single metallic blank. Preferably, the blank is a blank of metallic foil, preferably aluminum foil with a thickness of 0.0015 inches. The blank can be stamped from a ribbon of foil, perforated if desired, and erected into the radiant energy reflector sleeve, at various stations on a single machine, so that the sleeve can be formed as it is needed in the assembly of a smoking article in which it is used.

With reference to the FIGURES, radiant energy reflector sleeve 60 is formed from an appropriate blank 10 according to this invention. Blank 10 is shown in FIGS. 1–5 in various stages of erection. In all but FIG. 2, blank 10 is shown without perforations, but it is to be understood that the perforations 20 shown in FIG. 2 remain in FIGS. 3–5, where they are omitted only for ease and clarity of illustration.

Blank 10 has a central circular end face panel 11. Attached to opposite sides of end face panel 11 are two rectangular sleeve wall panels 12, 13. The circumference of end face panel 11 is substantially equal to the unwrapped circumference of the smoking article in which sleeve 60 is to be used, which is preferably from about 24.2 mm to about 24.5 mm. Each of sleeve wall panels 12, 13 has a long dimension and a short dimension, the dimensions of both panels 12, 13 preferably being substantially identical. Panels 12, 13 extend away from one another in the direction of their long dimensions, with their longitudinal centerlines 120, 130 parallel to, but offset from, one another. The length of each panel 12, 13 preferably is substantially the desired length of the finished sleeve 60, which preferably is about 21.8 mm. The width of each panel 12, 13 preferably is slightly more than half the circumference of end face panel 11. Panels 12, 13 are attached to panel 11 at areas 110, 111. As blank 10 is preferably made from a metallic foil such as aluminum foil, panels 12, 13 are foldably connected to panel 11.

Also foldably connected to end face panel 11 at areas 112, 113 are stiffening element panels 14, 15. Areas 112, 113 are offset approximately 90° from areas 110, 111. Stiffening element panels 14, 15 are positioned to stiffen sleeve 60, when erected, where wall panels 12, 13 overlap. Without panels 14, 15, the only rigidity of sleeve 60 would be that resulting from the attachment of panels 12, 13 to panel 11 at areas 110, 111.

Figure 2:
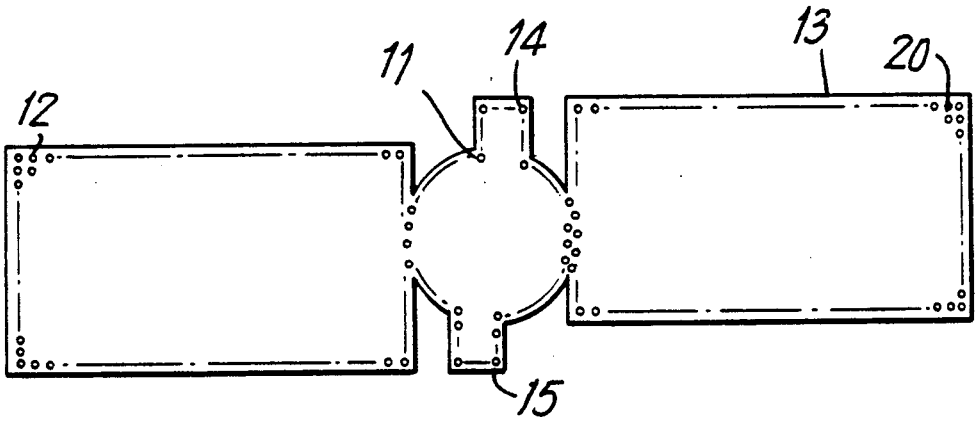
FIG. 2 is a plan view of the blank of FIG. 1 which has been perforated.

Perforations 20 may be formed in selected areas of blank 10, depending on which parts of sleeve 60 are desired to be perforated. As shown in FIG. 2, the entire blank 10 is perforated, which will result in the entire sleeve 60 being perforated. However, it is possible that one would want only certain portions of sleeve 60 to be perforated, in which case only certain corresponding parts of blank 10 would be perforated.

Blank 10 and sleeve 60 are preferably formed in a continuous or semi-continuous process in which blank 10 is stamped from a continuous roll of aluminum foil. Any desired perforations could be formed in blank 10 when it is stamped, or the perforations could be applied separately. In any event, any desired perforations are preferably applied to blank 10 before it is erected.

Figure 3:
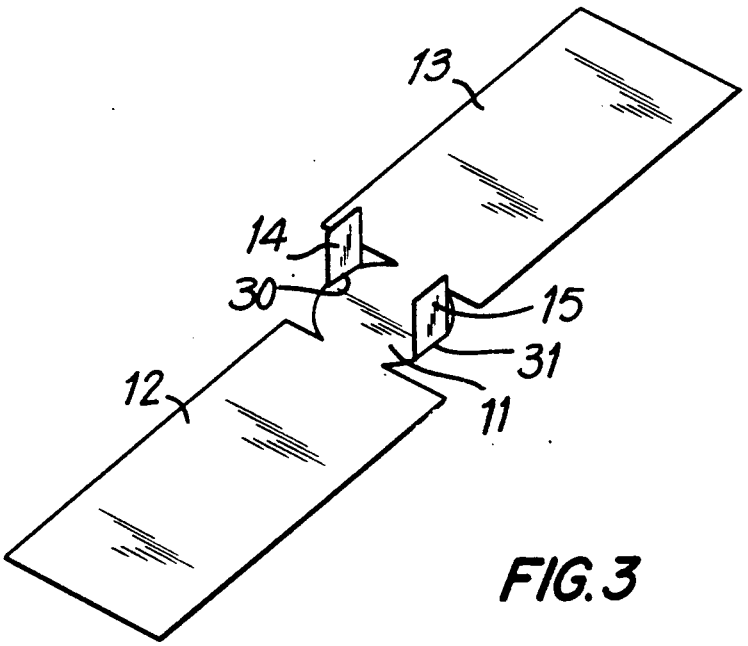
FIG. 3 is a perspective view of the blank of FIG. 1 after it has been partially erected.
Figure 7:
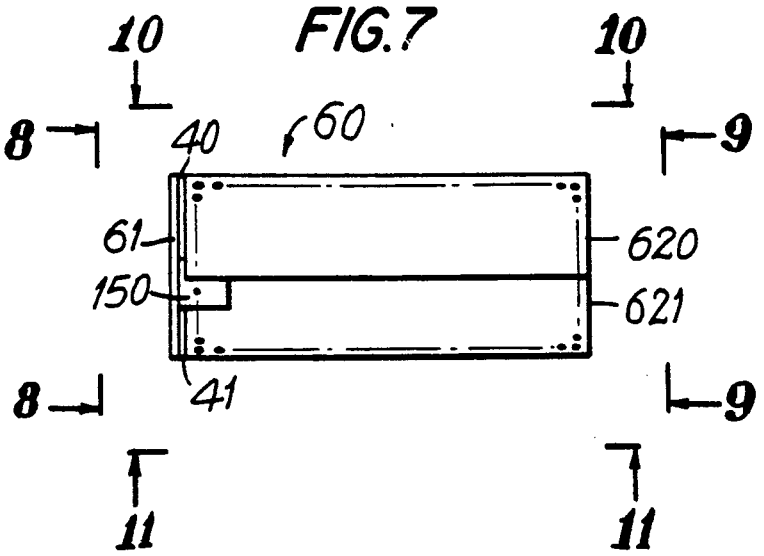
FIG. 7 is a side elevational view of the reflector sleeve of FIG. 6, taken from line 7—7 of FIG. 6.
Figure 8:
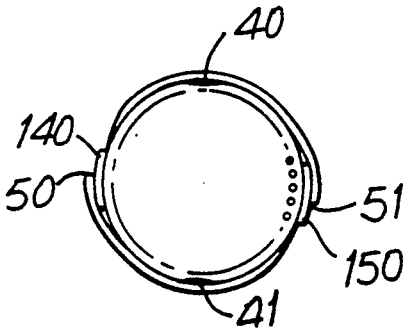
FIG. 8 is a front elevational view of the reflector sleeve of FIGS. 6 and 7, taken from line 8—8 of FIG. 7.
Figure 9:
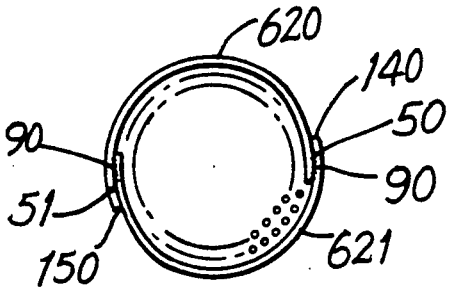
FIG. 9 is a rear elevational view of the reflector sleeve of FIGS. 6–8, taken from line 9—9 of FIG. 7.

After blank 10 has been stamped and perforated, it is erected, preferably in a single operation by a circular plunger (not shown), having substantially the same diameter as end face panel 11, which pushes panel 11 into a cooperating die (not shown). The die is preferably formed so that panels 14, 15 are erected before panels 12, 13. The erection sequence is shown in part in schematic form in FIGS. 3–5. In FIG. 3, panels 14, 15 have been erected by folding at areas 112, 113, forming fold lines 30, 31. In FIG. 4, panels 12, 13 have begun to assume a curved shape, and have begun to be folded upwards at areas 110, 111, forming fold lines 40, 41. In FIG. 5, blank 10 has been completely erected.

The completed sleeve 60 according to this invention, including perforations 20, is shown in FIGS. 6–11. Sleeve 60 has substantially circular end face 61, substantially cylindrical wall 62 formed from wall halves 620, 621, and stiffening elements 140, 150. Wall halves 620, 621 are attached to end face 61 at fold lines 40, 41, providing a first measure of rigidity to sleeve 60, and where halves 620, 621 overlap, stiffening elements 140, 150, attached to end face 61 at fold lines 30, 31, are interleaved with halves 620, 621, adding rigidity to the structure of sleeve 60.

If desired, for increased rigidity an adhesive 90 (FIG. 9) may be applied at seams 50, 51 where panels 12, 13 overlap. A preferred adhesive for this purpose is polyvinyl acetate. However, sleeve 60 can be used without adhesive at seams 50, 51.

Sleeve 60, with its integral end face 61, as shown, is ready for use as radiant energy reflector sleeve in a smoking or similar article as described above. It is designed to be overwrapped directly with the outer wrapper of the article, but intermediate layers could be used if desired.

Thus it is seen that a radiant energy reflector sleeve for a smoking or flavor generating article, having an integral end cap, and that could be formed as part of the assembly of the article, is provided. One skilled in the art will appreciate that the present invention can be practiced by other than the described embodiments, which are presented for purposes of illustration and not of limitation, and the present invention is limited only by the claims which follow.

What is claimed is:

1. A radiant energy reflector sleeve for use in an active element of a smoking article having a heat source and a flavor bed in heat transfer relationship with said heat source, said heat source suspended within said radiant energy reflector sleeve, said radiant energy reflector sleeve comprising:

a substantially cylindrical metallic wall;

a substantially flat, substantially circular metallic end face having a perimeter; and stiffening elements; wherein:

said wall, said end face and said stiffening elements are all erected from a single blank;

said wall comprises two overlapping substantially semicylindrical unitary wall segments foldedly connected to said end face at respective substantially diametrically opposed first and second portions of said perimeter; and said stiffening elements comprise two tabs foldedly connected to said end face at respective third and fourth portions of said perimeter, each of said tabs overlapping both of said wall segments.

2. The radiant energy reflector sleeve of claim 1 wherein said tabs are substantially rectangular.

3. The radiant energy reflector sleeve of claim 1 wherein said third and fourth portions of said perimeter are substantially diametrically opposed to one another.

4. The radiant energy reflector sleeve of claim 1 wherein said wall is perforated.

5. The radiant energy reflector sleeve of claim 1 wherein said end face is perforated.

6. The radiant energy reflector sleeve of claim 1 wherein said stiffening elements are perforated.

7. The radiant energy reflector sleeve of claim 1 wherein said blank comprises aluminum.

8. The radiant energy reflector sleeve of claim 1 wherein said wall segments are adhesively secured to one another where they meet.

9. The radiant energy reflector sleeve of claim 8 wherein said wall segments are secured with a polyvinyl acetate adhesive.

10. A method of making a radiant energy reflector sleeve for use in an active element of a smoking article having a heat source and a flavor bed in heat transfer relationship with said heat source, said heat source suspended within said radiant energy reflector sleeve, said method comprising the steps of:

providing a substantially flat metallic blank having a substantially circular end face panel, two sleeve wall panels, and two stiffening element panels, said end face panel having a perimeter; and erecting said blank to form a radiant energy reflector sleeve having a substantially flat, substantially circular metallic end face, a substantially cylindrical metallic wall comprising two overlapping substantially semicylindrical unitary wall segments foldedly connected to said end face at respective substantially diametrically opposed first and second portions of said perimeter, and stiffening elements comprising two tabs foldedly connected to said end face at respective third and fourth portions of said perimeter, each of said tabs overlapping both of said wall segments.

11. The method of claim 10 further comprising adhesively securing said wall segments to one another where they meet.

12. The method of claim 11 wherein said adhesive securing step comprises adhesively securing said segments with a polyvinyl acetate adhesive.

13. The method of claim 10 further comprising perforating at least a portion of said blank.

14. The method of claim 13 wherein said perforating step is performed prior to erection of said blank into said sleeve.

15. The method of claim 13 wherein said perforating step is performed after erection of said blank into said sleeve.

16. The method of claim 13 wherein said perforating step comprises perforating at least said end face panel, whereby at least said end face of said sleeve is perforated.

17. The method of claim 13 wherein said perforating step comprises perforating at least a portion of at least one of said sleeve wall panels, whereby at least a portion of said wall is perforated.

18. The method of claim 17 wherein said perforating step comprises perforating both of said sleeve wall panels, whereby said well is perforated.

19. The method of claim 13 wherein said perforating step comprises perforating said entire blank, whereby said entire sleeve is perforated.

20. A blank for a radiant energy reflector sleeve for use in an active element of a smoking article having a heat source and a flavor bed in heat transfer relationship with said heat source, said heat source suspended within said radiant energy reflector sleeve, said blank comprising:

a substantially circular end face panel, said end face panel having a perimeter;

two substantially rectangular sleeve wall panels foldably connected along short sides thereof to said end face at respective substantially diametrically opposed first and second portions of said perimeter, each of said short sides having a length greater than half said perimeter; and two stiffening element panels foldably connected to said end face at respective third and fourth portions of said perimeter.

21. The blank of claim 20 wherein at least a portion of said blank is perforated.

22. The blank of claim 21 wherein at least said end face panel is perforated.

23. The blank of claim 22 wherein at least a portion of at least one of said sleeve wall panels is perforated.

24. The blank of claim 23 wherein both of said sleeve wall panels are perforated.

25. The blank of claim 21 wherein said entire blank is perforated.

* * * * *